United States Patent [19]

Gross et al.

[11] Patent Number: 4,794,830

[45] Date of Patent: Jan. 3, 1989

[54] TOOL FOR LOOSENING FASTENERS

[75] Inventors: Joseph Gross, Moshav Mazor; David Lowenstein, Nethanya; Menachem Tilman, Hofit; Etan Rosenberg, Kiryat Ono; Amelia Orian, Tel-Aviv, all of Israel

[73] Assignee: General Ideas & Products Ltd., Tel Aviv, Israel

[21] Appl. No.: 149,257

[22] Filed: Jan. 28, 1988

[51] Int. Cl.[4] ..... B25B 19/00

[52] U.S. Cl. ..... 81/466; 173/93; 173/94

[58] Field of Search ..... 81/463–466; 173/93, 93.5, 94, 119, 121

[56] References Cited

U.S. PATENT DOCUMENTS

| | | | |
|---|---|---|---|
| 4,364,440 | 12/1982 | Clar | 81/466 X |
| 4,561,331 | 12/1985 | Pratt | 81/466 X |
| 4,708,209 | 11/1987 | Aspinwall | 173/94 X |

*Primary Examiner*—James G. Smith

*Attorney, Agent, or Firm*—Benjamin J. Barish

[57] ABSTRACT

A tool for loosening fasteners, comprises an applicator bar formed with a socket for receiving the fastener to be loosened, a handle fixed to a housing rotatable about the applicator bar for loosening the fastener received in the socket, a hammer within the housing and connected thereto by a spring, and an anvil carried by the applicator bar. The tool further includes a rod coupling the anvil to the hammer in the initial position of the hammer and effective to prevent relative movement therebetween, and thereby to load the spring during the rotation of the operating handle in one direction, and a releasing device effective, after the operating handle has been rotated a predetermined distance, to release the coupling rod, whereby the loaded spring causes the hammer to impact against the anvil to thereby loosen the fastener received in the socket of the applicator bar.

18 Claims, 3 Drawing Sheets

FIG 2
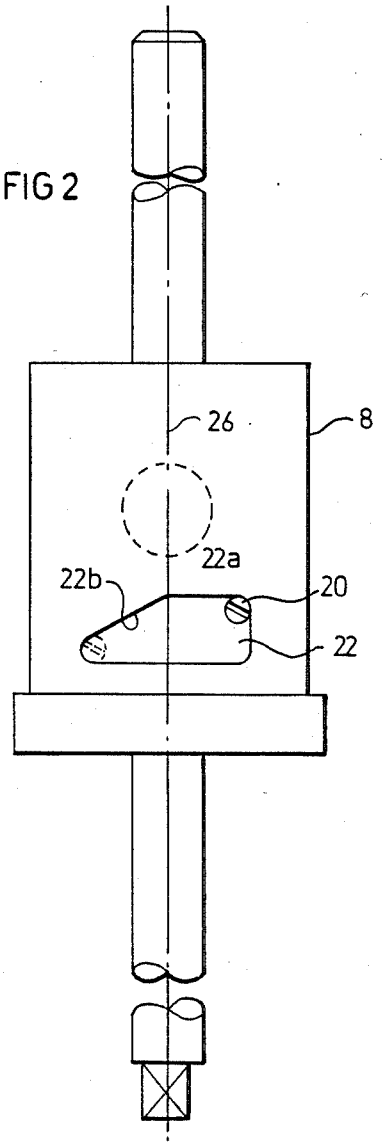
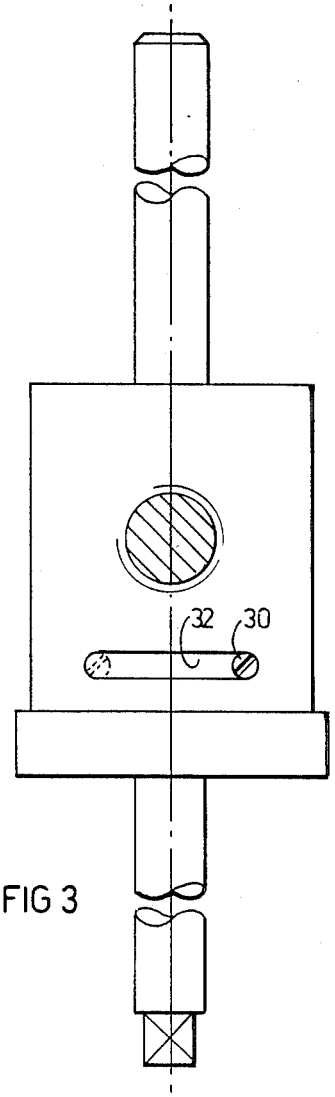
FIG 3

TOOL FOR LOOSENING FASTENERS

BACKGROUND OF THE INVENTION

The present invention relates to a tool for loosening fasteners, such as the bolts used for securing a tire to an automotive vehicle.

Fasteners, such as bolts and nuts, frequently become "frozen" in place, e.g., by rust, such that they are difficult to remove by conventional wrenches. This problem is particularly present when changing a vehicle tire if the tire bolts have not been removed for a long period of time. When this occurs, it is necessary to apply an extremely large force to the tire bolt, which is not always possible with the tools available, in order to "unfreeze" or loosen the bolt and to permit its removal for changing the tire.

BRIEF SUMMARY OF THE INVENTION

An object of the present invention is to provide a tool which may be used for loosening fasteners in general, and tire bolts in particular.

According to the present invention, there is provided a tool for loosening fasteners, comprising a applicator bar carry a fastener-engaging member for engaging the fastener to be loosened; an operating handle manually rotatable about the longitudinal axis of the applicator bar; a housing fixed to the operating handle so as to be rotated therewith; a hammer within the housing and movable relative thereto; and a spring connecting the hammer to the housing so as to be loaded by the relative movement of the housing with respect to the hammer. The tool further includes an anvil carried by the applicator bar normally spaced from the hammer in the initial position of the hammer; coupling means between the hammer and anvil coupling the anvil to the hammer in the initial position of the hammer and effective to prevent relative movement therebetween, and thereby to produce relative movement between the hammer and housing to load the spring during the rotation of the operating handle in one direction; and a releasing device effective, after the operating handle has been rotated a predetermined distance in the one direction, to release the coupling means, whereby the loaded spring causes the hammer to impact against the anvil to thereby loosen the fastener received in the socket of the applicator bar.

According to a further feature in the described preferred embodiment, the tool further includes resetting means for returning the hammer to its initial position spaced from the anvil, and for recoupling the hammer to the anvil, upon the rotation of the operating handle in the opposite direction; more particularly, the resetting means in the described embodiment includes a resetting pin fixed at one end to the hammer, the opposite end of the resetting pin passing through a resetting slot formed in the housing.

It will thus be seen that a tool constructed in accordance with the foregoing features is effective to loosen a frozen or tight fastener by applying impacts to the fastener. Such a tool has been found particularly effective for loosening the tire bolts when changing a vehicle tire.

One embodiment of the invention is described below for purposes of example. In the described embodiment the fastner-engaging member is a socket fixed to one end of the applicator bar, the coupling means comprises a locking rod received within aligned bores formed in the hammer and anvil; and the releasing device comprises a releasing pin having one end received within the locking rod, the opposite end of the releasing pin projecting through an opening in the housing. More particularly, the latter opening in the housing is in the form of a cam slot having a cam surface engageable with the releasing pin and effective to move it axially to decouple the hammer from the anvil when the housing has been rotated the predetermined distance in the one direction by the operating handle.

Further features and advantages of the invention will be apparent from the description below.

BRIEF DESCRIPTION OF THE DRAWINGS

The invention is herein described by way of example only, with reference to the accompanying drawings, wherein:

FIG. 2 is a front elevational view of the tool of FIG. 1;

FIG. 3 is a rear elevational view of the tool of FIG. 1; and

DESCRIPTION OF A PREFERRED EMBODIMENT

Figure 1:
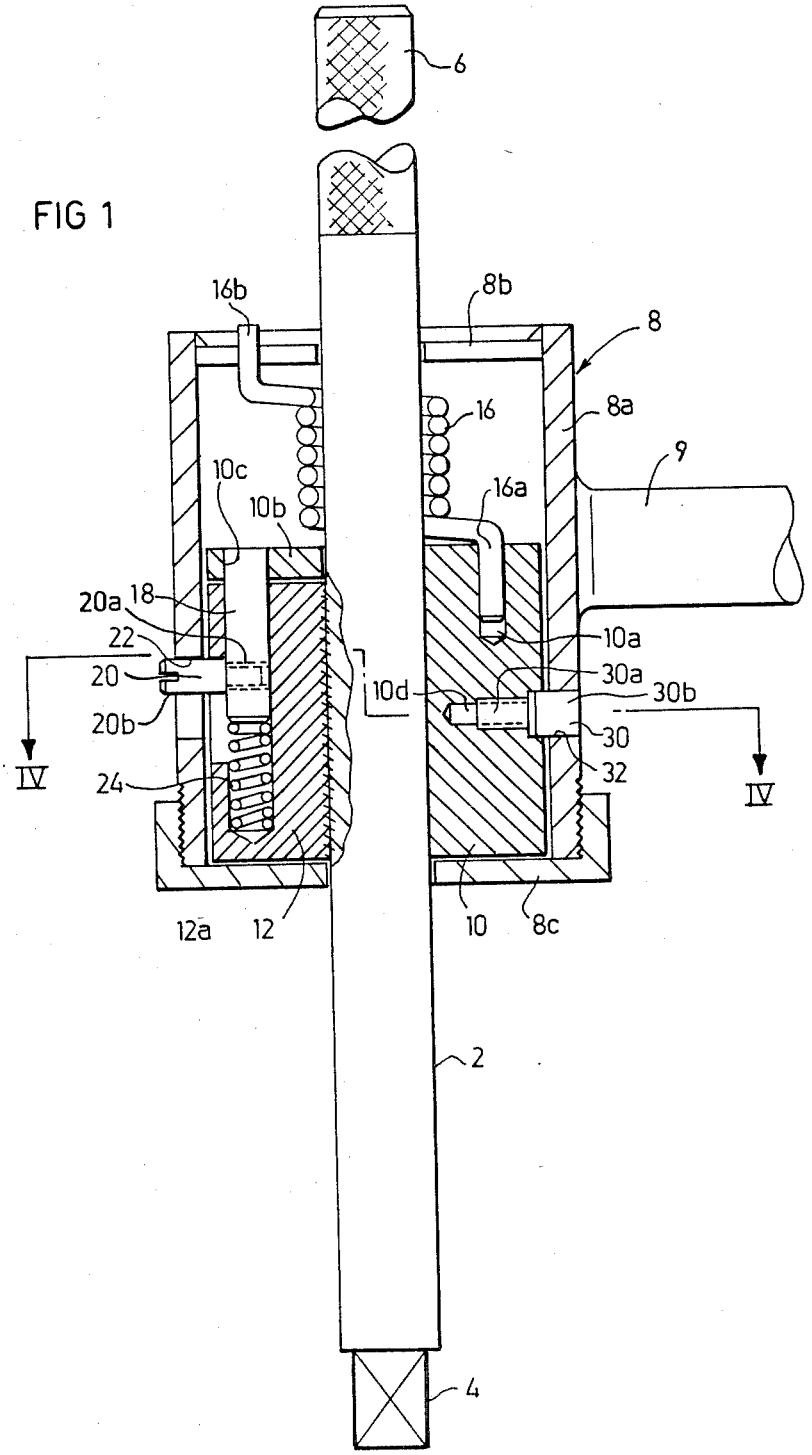
FIG. 1 is a longitudinal sectional view illustrating one form of fastener-loosening tool constructed in accordance with the present invention.

The tool illustrated in the drawings is particularly useful for loosening tire bolts when changing a vehicle tire. The tool comprises an applicator bar 2 of solid cylindrical configuration carrying, at one end, a socket 4 configured to receive the head of the tire bolt to be loosened. The opposite end of applicator bar 2 rotatably carries a sleeve 6 whose outer face may be knurled in order to facilitate manual gripping of the applicator bar.

The illustrated tool further includes a housing 8 formed with a cylindrical side wall 8*a* closed at one end by a top wall 8*b* secured thereto, as by welding, and closed at the opposite end by a bottom wall 8*c* removably attached to the side wall by threads 8*d*. The two end walls 8*b*, 8*c* of housing 8 are formed with central aligned openings of slightly larger diameter than the outer diameter of applicator bar 6 so as to rotatably receive the applicator bar. An operating handle 9 is secured, as by welding, to the outer face of the housing side wall 8*a*.

Disposed within housing 8 are a hammer 10 and an anvil 12. As shown particularly in FIGS. 4*a*–4*d*, hammer 10 is of generally cylindrical configuration, but formed with a cut-out, and as freely movable with respect to applicator bar 6 and housing 8; whereas anvil 12 is integrally formed with the applicator bar 6, and is of sector configuration received within the cut-out of hammer 10. In the illustrated arrangement, hammer 10 extends an arcuate distance of above 240°, whereas anvil 12 extends an arcuate distance of about 60°, thereby leaving a space 14 of about 60° between the two.

Also disposed within housing 8 is a coil spring 16 connecting hammer 10 to housing 8 so as to be loaded by the relative movement of the housing with respect to the hammer. For this purpose, one end 16*a* of coil spring 16 is received within an axial bore 10*a* formed in one side of hammer 10, the opposite end 16*b* of the spring being received within an opening formed in housing end wall 8*b*.

Figure 4A:
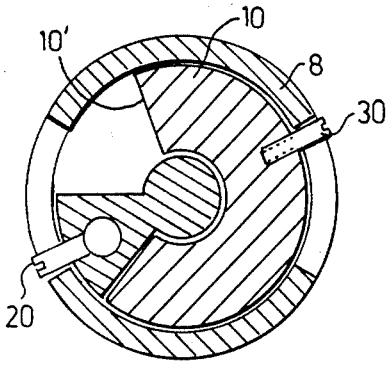
FIGS. 4*a*–4*d* are sectional views along line IV—IV illustrating the condition of the elements during four stages in the use of the tool for loosening a fastener.

As also shown in FIG. 1, hammer 10 is formed at its upper end with a circular extension 10*b* overlying anvil 12 and formed with a bore 10*c*. Anvil 12 is formed with a bore 12*a* adapted to be aligned with bore 10*c* of hammer extension 10*b* in the normal position of the hammer as illustrated in FIGS. 1 and 4*a*. When the hammer is in this normal position, a locking rod 18 received within aligned bores 10*c* and 12*a* couples the anvil 12 to the hammer 10 and is effective to prevent relative movement between them.

Anvil 12 may be decoupled from hammer 10 by means of a releasing pin 20 having one end 20*a* threaded into locking rod 18, the opposite end 20*b* of releasing pin 20 projecting through a cam slot 22 formed in housing side wall 8*a*. A spring 24 received in the bottom of anvil bore 12*a* normally urges locking rod 18 to its raised position such that its upper end is seated within hammer bore 10*c*, thereby coupling the anvil to the hammer.

FIG. 2 more particularly illustrates the configuration of cam slot 22, wherein it will be seen that it includes two cam surfaces 22*a*, 22*b* engageable with releasing pin 20 and effective to move the releasing pin in the axial direction during the rotation of the housing. Thus, cam surface 22*a* extends in a plane which is substantially perpendicular to the axis of rotation 26 of the housing, and therefore will not effect axial movement of the resetting pin 20; whereas cam surface 22*b* extends in a plane having a downward incline with respect to the axis of rotation 26 of the housing, and therefore will move the resetting pin 20 downwardly within the anvil bore 12*a* so as to decouple the anvil from extension 10*b* of the hammer 10. Spring 24 engaging the lower end of locking rod 18 continuously urges the locking rod upwardly, and thereby urges resetting pin 20 upwardly against either cam surface 22*a* or 22*b* of cam slot 20, according to the position of housing 8.

The opposite side of hammer 10 is formed with a further bore 10*d* adapted to receive one end 30*a* of a resetting pin 30. The opposite end 30*b* of the resetting pin projects through a slot 32 formed in housing side wall 8*a*. As shown in FIG. 3, slot 32 extends circumferentially of the housing side wall for a short distance, e.g., 60°. Pin 30 movable within slot 32 is effective to reset the spaced position of hammer 10 with respect to anvil 12, after the hammer has impacted the anvil in order to loosen the fastener received within socket 4 of the applicator bar 6.

The operation of the illustrated tool will now be described with particular reference to FIGS. 4*a*–4*d* illustrating the position of the hammer 10 and anvil 12 during the various stages of operation of the tool.

Thus, in the norma condition of the tool, hammer 10 is spaced from anvil 12, and is retained in this spaced relationship by locking rod 18 received within the hammer bore 10*c* and the anvil bore 12*a*. In this normal condition of the tool, release pin 20 is in its upper position in cam slot 22 as illustrated in FIGS. 1 and 2, and resetting pin 30 is at its rightmost position in its slot 32 as illustrated in FIG. 3. This normal condition of the tool is also illustrated in FIG. 4*a*, wherein it will be seen that impact surface 10′ of hammer 10 is spaced from anvil 12. In this normal condition of the tool coil spring 16 connecting hammer 10 to housing 8 is in a relaxed condition.

Socket 4 of the applicator bar 6 is applied over the fastener, e.g., a tire bolt, to be loosened while knurled sleeve 6 of the applicator bar is gripped by one hand, and operating handle 9 is gripped by the other hand.

Figure 4B:
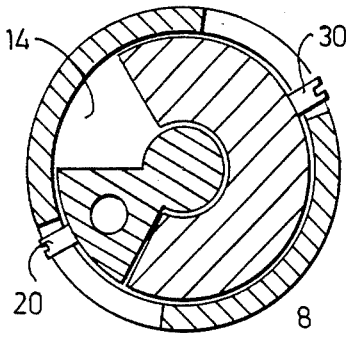

The user then rotates handle 11, and thereby housing 8 secured to it, in one direction, this being the counterclockwise direction illustrated in FIG. 4*b*. Since applicator bar 2 and its anvil 12 are not, at this time, rotated because of the engagement of socket with the fastener to be loosened, and since hammer 10 is coupled by locking rod 18 to anvil 12, relative movement is effected between hammer 10 and housing 8 (FIG. 4*b*), thereby loading the coil spring 16.

During this rotary movement of the housing 8, release pin 20 moves along the upper cam surface 22*a* (FIG. 2) of cam slot 22, which surface produces no axial movement of the release pin and thereby of the locking rod 18. However, as soon as release pin 20 engages cam surface 22*b*, the latter surface moves release pin 20 in the axial direction moving locking rod 18 out of the hammer bore 10*c*, such that when the releasing pin 20 reaches the end of cam slot 22*b*, the locking rod 18 will have move completely out of bore 10*c*. As soon as this occurs, hammer 10 is no longer coupled to anvil 12, and therefore the spring 16, previously loaded by the rotation of housing 8, causes the hammer 10 to impact against anvil 12. The impact force applied to anvil 12 is transmitted via applicator bar 2 to socket 4 receiving the fastener thereby tending to loosen the fastener.

Figure 4C:
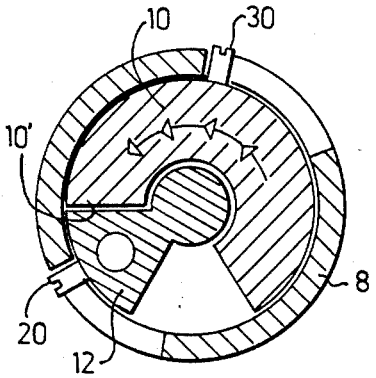

FIG. 4*c* illustrates the relative position of the parts at the time of this impact. At this time, the releasing pin 20 is in the broken-line position illustrated in FIG. 2 with respect to its cam slot 22, and the resetting pin 30 is in the broken-line position illustrated in FIG. 3 with respect to its slot 32.

Figure 4D:
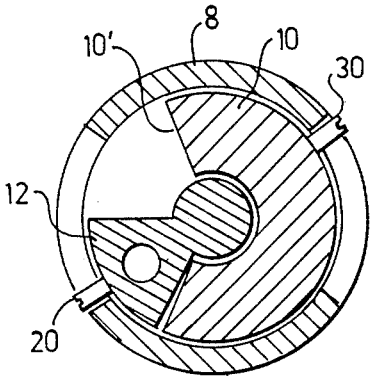

After the hammer 10 has thus impacted against anvil 12 to loosen the fastener received within socket 4 of the applicator bar 6, the housing may be returned to its normal position by rotating handle 9 in the opposite direction, this being the clockwise direction illustrated in FIG. 4*d*. During this rotation of the housing, hammer 10 is rotated with the housing by resetting pin 30 and spring 16, thereby moving the hammer to its initial position spaced from anvil 12, this being permitted because of the unseating of locking rod 18 from the hammer bore 10*c*. As soon as locking rod 18 is aligned with hammer bore 10*c*, spring 24 moves the locking rod upwardly to seat itself within bore 10*c*, thereby relocking the hammer to its initial position, wherein its impact surface 10′ (FIG. 4*a*) is again spaced from anvil 12, peparatory for a new cycle of operation to apply another impact against the anvil should that be necessary.

While the invention has been described with respect to one preferred embodiment, it will be appreciated that many variations, modifications and other applications of the invention may be made.

What is claimed is:

1. A tool for loosening fasteners, comprising:

an applicator bar carrying a fastener engaging member for engaging the fastener to be loosened;

an operating handle manually rotatable about the longitudinal axis of the applicator bar;

a housing fixed to said operating handle so as to be rotated therewith;

a hammer within said housing and movable relative thereto;

a spring connecting said hammer to the housing so as to be loaded by the relative movement of the housing with respect to the hammer;

an anvil carried by said applicator bar normally spaced from the hammer in the initial position of the hammer;

coupling means between said hammer and anvil coupling the anvil to the hammer in the initial position of the hammer and effective to prevent relative movement therebetween, and thereby to produce relative movement between the hammer and housing to load the spring during the rotation of the operating handle in one direction;

and a releasing device effective, after the operating handle has been rotated a predetermined distance in said one direction, to release said coupling means, whereby the loaded spring causes the hammer to impact against the anvil to thereby loosen the fastener received in the socket of the applicator bar.

2. The tool according to claim 1, wherein said coupling means comprises a locking rod received within aligned bores formed in said hammer and anvil.

3. The tool according to claim 2, wherein the bore in said hammer receiving the locking rod is formed in an extension of the hammer at one side of the anvil.

4. The tool according to claim 2, wherein said releasing device comprises a releasing pin having one end received within said locking rod, the opposite end of said releasing pin projecting through an opening in said housing.

5. The tool according to claim 4, wherein said opening in the housing is in the form of a cam slot having a cam surface engageable with said releasing pin and effective to move it axially to decouple said hammer from said anvil when the housing has been rotated said predetermined distance in said one direction by the operating handle.

6. The tool according to claim 5, further including a spring in the bore of the anvil urging the locking rod to its coupling position with respect to said hammer.

7. The tool according to claim 1, further including resetting means for returning the hammer to its initial position spaced from the anvil, and for recoupling the hammer to said anvil, upon the rotation of said operating handle in the opposite direction.

8. The tool according to claim 7, wherein said resetting means includes a resetting pin fixed at one end to said hammer, the opposite end of the resetting pin passing through a resetting slot formed in the housing.

9. The tool according to claim 1, wherein said spring is a coiled spring having one end received within an opening in an end wall in said housing, the opposite end of said coil spring being received within a bore formed in said hammer.

10. The tool according to claim 1, wherein said housing is of cylindrical configuration, said hammer is also of cylindrical configuration but formed with a cut-out to accommodate the anvil, and said anvil is of sector configuration within said cut-out and subtending an arc of less than 90°.

11. The tool according to claim 1, wherein said applicator bar is of cylindrical configuration and said fastener-engaging member is a socket fixed to one end thereof the opposite end of said applicator bar rotatably carrying a manually-grippable sleeve.

12. A tool for loosening fasteners, comprising:

an applicator bar formed with a socket for receiving the fastener to be loosened;

an operating handle manually rotatable about the longitudinal axis of the applicator bar;

a housing fixed to said operating handle so as to be rotated therewith;

a hammer within said housing and movable relative thereto;

a spring connecting said hammer to the housing so as to be loaded by the relative movement of the housing with respect to the hammer;

an anvil carried by said applicator bar normally spaced from the hammer in the initial position of the hammer;

coupling means between said hammer and anvil coupling the anvil to the hammer in the initial position of the hammer and effective to prevent relative movement therebetween, and thereby to produce relative movement between the hammer and housing to load the spring during the rotation of the operating handle in one direction;

a releasing device effective, after the operating handle has been rotated a predetermined distance in said one direction, to release said coupling means, whereby the loaded spring causes the hammer to impact against the anvil to thereby loosen the fastener received in the socket of the applicator bar;

and resetting means for returning the hammer to its initial position spaced from said anvil, and for recoupling the hammer to the anvil, by the rotation of said operating handle in the opposite direction.

13. The tool according to claim 12, wherein said resetting means includes a resetting pin fixed at one end to said hammer, the opposite end of the resetting pin passing through a resetting slot formed in the housing.

14. The tool according to claim 12, wherein said coupling means comprises a locking rod received within aligned bores formed in said hammer and anvil, and said releasing device comprises a releasing pin having one end received within said locking rod, and with the opposite end projecting through an opening in said housing.

15. The tool according to claim 14, wherein said opening in the housing is in the form of a cam slot having a cam surface engageable with said releasing pin and effective to move it axially to decouple said hammer from said anvil when the housing has been rotated said predetermined distance in said one direction by the operating handle.

16. The tool according to claim 15, wherein said spring is a coiled spring having one end received within an opening in an end wall in said housing, the opposite end of said coil spring being received within a bore formed in said hammer.

17. The tool according to claim 16, wherein said housing is of cylindrical configuration, said hammer is also of cylindrical configuration but formed with a cut-out to accommodate the anvil, and said anvil is of a sector configuration within said cut-out and subtending an arc of less than 90°.

18. The tool according to claim 12, wherein said applicator bar is of cylindrical configuration and carries said socket fixed to one end thereof, the opposite end of said applicator bar rotatably carrying a manually-grippable sleeve.

* * * * *